United States Patent [19]

Carlson

[11] 4,248,261

[45] Feb. 3, 1981

[54] EDUCTION PIPE ASSEMBLY HAVING UPPER FLEXIBLE MEMBER

[75] Inventor: Edwin S. Carlson, St. Charles, Mo.

[73] Assignee: ACF Industries, Incorporated, New York, N.Y.

[21] Appl. No.: 68,268

[22] Filed: Aug. 20, 1979

[51] Int. Cl.[3] ..... F17D 1/00; B65D 83/14; F16L 11/12

[52] U.S. Cl. ..... 137/590; 285/45; 222/398

[58] Field of Search ..... 137/590, 125, 350; 285/45, 226, 301; 222/377, 382, 398, 464; 220/85 S

[56] References Cited

U.S. PATENT DOCUMENTS

| | | | |
|---|---|---|---|
| 1,726,483 | 8/1929 | Giesler | 285/45 |
| 1,748,185 | 2/1930 | Nichols et al. | 220/85 S |
| 1,894,655 | 1/1933 | Auchincloss | 137/590 |
| 2,174,354 | 9/1939 | Shields | 137/590 |
| 3,369,829 | 2/1968 | Hopkins | 285/301 |
| 4,114,783 | 9/1978 | Wempe | 137/590 |

*Primary Examiner*—Martin P. Schwadron
*Assistant Examiner*—A. Michael Chambers
*Attorney, Agent, or Firm*—Henry W. Cummings

[57] ABSTRACT

An eduction pipe assembly includes a movable eduction pipe extending downwardly from the top of the tank toward a sump located in the bottom of the tank. The eduction pipe is supported from the upper portion of the tank. In the upper portion of the tank a flexible member is sealingly attached to an upper end portion of the eduction pipe. The flexible member extends upwardly and is sealingly attached at its upper end to an opening in the top of the tank. Preferably the flexible member is located in a dome in the top of the tank and thus is not in contact with the lading for extended periods of time. Preferably the flexible member is made of a material such as stainless steel which is resistant to corrosive attack by most ladings to be transported in the tank.

3 Claims, 2 Drawing Figures

EDUCTION PIPE ASSEMBLY HAVING UPPER FLEXIBLE MEMBER

BACKGROUND OF THE INVENTION

In application Ser. No. 905,242 filed May 12, 1977, now U.S. Pat. No. 4,214,047 issued Aug. 26, 1980 a telescoping eduction pipe assembly is disclosed including an elastomeric boot connected between a movable eduction pipe portion and a fixed eduction pipe portion located in the lower interior of a railway tank car. Since the elastomeric boot is located in the lower interior portion of the tank, the elastomeric boot is in continuous contact with the lading. Some ladings may corrode the elastomeric boot and/or the fasteners attaching the boot to the fixed eduction pipe portion and/or the movable eduction pipe portion. Some ladings tend to creep past the seals between the elastomeric boot and the fixed and movable eduction pipes. Gradually the seal deteriorates until the eduction pipe is no longer sealed with respect to the interior of the car. The elastomeric boot and/or its seals must then be replaced.

It would be desirable to provide a movable eduction pipe portion which would contact the lading to a lesser extent than the elastomeric boot described in application Ser. No. 905,242.

It would also be desirable to provide a flexible, movable eduction pipe portion made of a material which is resistant to attack of most ladings to be transported in the tank, to counteract lading attack which tends to occur as a result of lading contact.

SUMMARY OF THE INVENTION

An eduction pipe assembly includes an eduction pipe portion extending downwardly from the top of the tank toward a sump located in the bottom of the tank. The eduction pipe is supported from the top of the tank. In the upper portion of the tank a flexible member is sealingly attached to an upper end portion of the eduction pipe. The flexible member extends upwardly and is sealingly attached at its upper end to an opening in the top of the tank. Preferably the flexible member is located in a dome in the top of the tank and thus is not in contact with the lading for extended periods of time. Preferably the flexible member is made of a material which is resistant to corrosive attack by most ladings to be transported in the tank and is sufficiently strong to support the eduction pipe. A preferred material is stainless steel. However, other metallic or elastomeric materials may be used, depending upon the lading to be transported. Preferably a non-flexible housing or guide is provided surrounding the flexible member which is also attached to the top of the tank. Preferably also the housing includes a guide stop which engages an eduction pipe stop located on the eduction pipe to support the eduction pipe and reduce the tendency for the eduction pipe to oscillate.

THE DRAWINGS

FIG. 1 is a vertical sectional view illustrating the eduction pipe assembly of the present invention; and FIG. 2 is a horizontal sectional view looking in the direction of the arrows 2—2 in FIG. 1.

DESCRIPTION OF PREFERRED EMBODIMENTS

Figure 1:
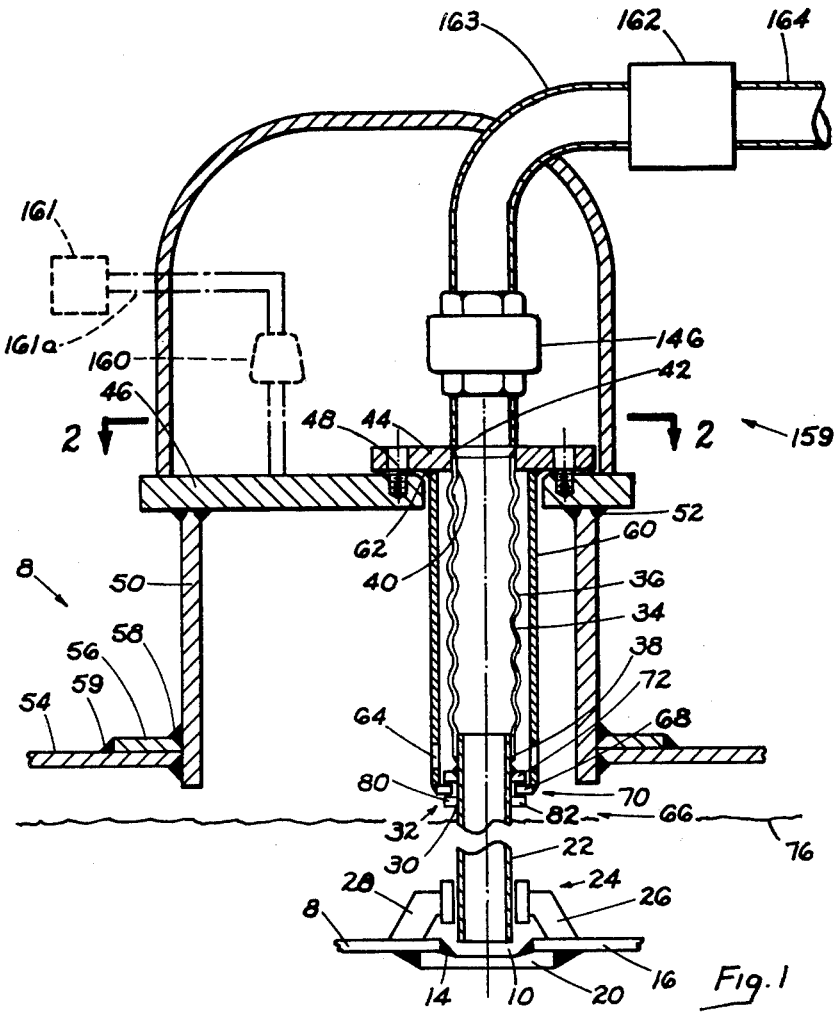
Figure 2:
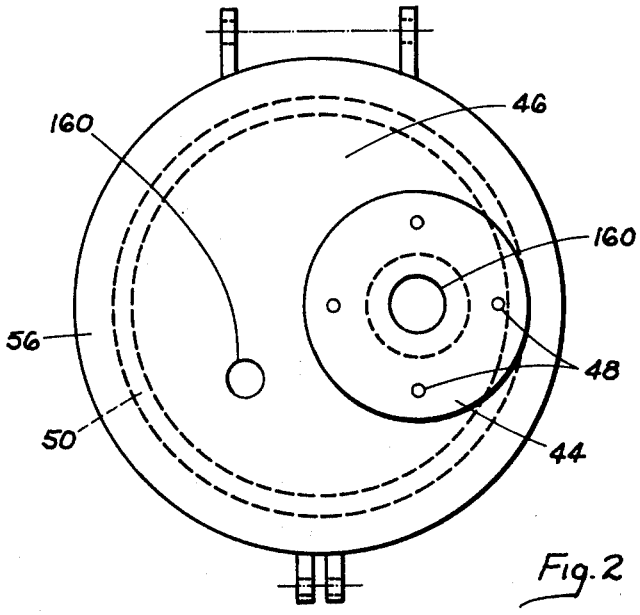

In a railway tank car 8, a sump 10 is defined in part by an opening 14 in a tank bottom 16, and by a sump plate 20 welded to the tank bottom 16.

An eduction pipe 22 extends downwardly from the top of the tank. Pipe 22 is supported laterally by a bracket assembly 24 including legs 26 and a horizontal portion 28.

At the upper end 30 of eduction pipe 22 a flexible eduction pipe portion 32 is located. Flexible eduction pipe portion 32 includes a flexible member 34, preferably a bellows 36, attached at 38 by welding to the upper end 30 of fixed eduction pipe 22. Bellows 36 is preferably made of corrosion resistant material with respect to the ladings to be transported. It is preferred that bellows 34 be made of stainless steel for this reason.

At its upper end 40, bellows 34 is attached to an opening 42 in a plate 44. Plate 44 is attached to a dome plate 46 by means of fasteners 48. Dome plate 44 is attached to a circular dome or nozzle 50 by welding indicated at 52. Dome 50 is attached to the tank top 54 by means of a plate 56 and welding 58 and 59.

Also attached to dome plate 44 is a depending housing or guide 60. Housing 60 is conveniently a pipe of circular cross section attached to dome plate 44 by welding indicated at 62. Housing 60 is hollow and extends downwardly around flexible member 34. Lading drain holes 64 are provided at the lower end of housing 60.

In addition, a housing stop means is provided indicated at 66. Housing stop means 66 comprises a plate 68 welded to the inner end of housing 60 and extending radially inwardly toward eduction pipe 22.

Eduction pipe 22 also includes an eduction pipe stop means 70. Eduction pipe stop means 70 includes a plate 72 welded to eduction pipe 22 extending horizontally outwardly toward housing 60, and spaced therefrom to allow relative movement between the plate 72 and the housing 60. In normal position housing stop means 66 support eduction pipe stop means 70 and eduction pipe 22.

As described in U.S. Pat. No. 4,114,783, hereby incorporated into this application by this reference, means 159 are provided to provide a pressure differential between valve means 146 and the sump 10. An air inlet valve 160 of conventional construction is provided to apply pressure from a pressure source 161 through a conduit 161*a* to the lading to force the lading up through eduction pipe 22 and through flexible eduction pipe portion 32. Alternatively a conventional pump 162 may be connected to outlet valve 146 through a conduit 163. Conduit 163 is in fluid communication with opening 42 in plate 44. Sealing welds 38 and 42 ensure that a pressure differential is maintained between sump 10 and valve means 146 for successful unloading, particularly when the lading level is at the lower end of movable eduction pipe portion 42. An unloading hose or pipe 164 is attached to unloading valve 146 or to an unloading pump 162 to carry the lading to a receiving container (not shown).

In operation, differential pressure is applied either by pump 162 or air pressure applied through connection 161 to force the lading into sump 10, up through fixed eduction pipe 22, then into flexible eduction pipe portion 32. The lading then passes out of the tank. Welds 38 and 42 maintain a seal between eduction pipe portions 22 and 32 and the interior of the tank, so that nearly all of the liquid at the bottom of the tank can be unloaded with the sump and eduction pipe arrangement of the present invention. When the tank top moves downwardly relative to the tank bottom, for example under coupling impact or train action, the tank top 54, dome 50, and eduction pipe portions 22 and 32 move downwardly relative to guide 28 and the tank bottom. Eduction pipe portion 22 may abut the bottom of sump 10. The flexible portion 32 then allows the tank top 54 and guide 60 to telescope relative to tank bottom 16 and eduction pipe portion 22.

It will be apparent that the lading within the tank normally extends up to slightly below the tank top 54 as indicated at 76 in FIG. 1. Thus the lading is in contact with the flexible portions to a considerable less extent than in application Ser. No. 905,242. It is true that during impacts in a railyard and when the car is on incline in transit, the lading will move into the dome 50. Furthermore, the lading will enter the opening 64 and contact the bellows 36. However, since the bellows is made of stainless steel, there is considerably less tendency for the lading to attack the bellows than with the elastomeric member in application Ser. No. 905,242.

Furthermore, the welded joint between the flexible member 36 and the fixed eduction pipe portion 22 renders this joint less susceptible to attack from the lading. Moreover, over a period of time there is less tendency for this welded joint to deteriorate and take away the seal between eduction pipe and the interior of the tank.

A pair of shear pins 80 and 82 are welded to eduction pipe portion 22. These shear pins are welded to eduction pipe portion 22 to maintain the eduction pipe assembly in place until such time as the car receives a hard impact.

When the tank is impacted, the top of the tank 54 and the dome plate 56 move downwardly relative to the tank bottom 16. Eduction pipe 22 also moves downwardly and may abut the bottom of sump 10. When this occurs, the bellows 36 moves downwardly and compresses relative to the eduction pipe portion 22. The housing 60 guides movement of the bellows [illegible]wardly around the eduction pipe portion 22.

After the initial downward movement, the housing stop means 66 engage the eduction pipe stop means 70. In particular plate 68 engages plate 72 to prevent oscillation of the tank top and the dome relative to the tank bottom.

It is also to be noted that since sump 10 is defined by a plate 20 and an opening 14 in the tank bottom, and since plate 20 is preferably less than one (1) inch thick, it is not necessary to utilize a skid in order for this arrangement to comply with AAR and DOT regulations concerning projections below the tank bottom.

It is particularly to be noted that the location of the flexible member out of contact with the lading for most of the time while the car is in use, and the use of corrosion resistant material for the bellows, tends to result in a longer life of the bellows material than is the case with Ser. No. 905,242. Furthermore, the welded joint between the bellows and the fixed eduction pipe at the lower end and the dome plate at the upper end reduce the tendency for the seals to deteriorate over a period of time, resulting in loss of the seal between the eduction pipe 22–32 and the interior of the tank.

What is claimed is:

1. An eduction pipe assembly comprising: a sump located in the bottom of a railway tank car; said tank car having a dome extending above the car and located above said sump; an eduction pipe located above the sump and extending upwardly toward said dome; support means located in the bottom portion of said tank supporting said eduction pipe laterally within the tank; a flexible member sealingly attached to an upper end portion of the eduction pipe; said flexible member extending upwardly into said dome and being sealingly attached at its upper end to laterally extending support means in said dome; conduit means extending out of the dome also attached to said laterally extending support means and being in fluid communication with said flexible member; said flexible member being made of a material which is resistant to corrosive attack by ladings to be transported in the tank; a non-flexible housing attached to said support means and extending downwardly surrounding said flexible member; said housing including housing stop means which engage eduction pipe stop means located on the eduction pipe; in normal position said housing stop means supporting said eduction pipe and said flexible member within said dome and substantially out of contact with the lading; and when the tank top moves downwardly relative to the bottom after initial movement said eduction pipe being supported by said sump, and said dome and said housing moving downwardly relative to said eduction pipe with said flexible member folding upon itself; and whereby after said downward movement said flexible member returns to its original position within said dome, substantially out of contact with the lading.

2. An eduction pipe assembly according to claim 1 wherein said eduction pipe includes laterally extending stops which shear off when said housing moves downwardly relative to said tank bottom upon coupling impact.

3. An eduction pipe assembly according to claim 1 wherein the corrosion resistant material is stainless steel.

* * * * *